United States Patent [19]

Knight, Jr.

[11] Patent Number: 4,754,916

[45] Date of Patent: Jul. 5, 1988

[54] BULK BIN WITH REPLACEABLE CELLS

[75] Inventor: Onis A. Knight, Jr., Hurst, Tex.

[73] Assignee: Container Corporation of America, Clayton, Mo.

[21] Appl. No.: 119,911

[22] Filed: Nov. 13, 1987

[51] Int. Cl.[4] ..... B65D 5/48

[52] U.S. Cl. ..... 229/120.35; 229/120.23

[58] Field of Search ..... 229/120.12, 120.23, 229/120.35, 120.29, 120.37

[56] References Cited

U.S. PATENT DOCUMENTS

| | | | |
|---|---|---|---|
| 345,510 | 7/1886 | Jenkins et al. | 229/120.35 |
| 3,252,646 | 5/1966 | Rockefeller | 229/120.37 |
| 3,403,835 | 10/1968 | Schwaner | 229/120.37 |
| 3,967,772 | 7/1976 | Baker | 229/120.23 |

FOREIGN PATENT DOCUMENTS

| | | | |
|---|---|---|---|
| 132090 | 6/1951 | Sweden | 229/120.35 |

*Primary Examiner*—Stephen Marcus
*Assistant Examiner*—Gary E. Elkins
*Attorney, Agent, or Firm*—Richard W. Carpenter

[57] ABSTRACT

A composite receptacle, such as bulk bin, including an outer container formed from a unitary blank of foldable paperboard, and including four side wall panels foldably joined to each other to form a collapsable, tubular, outer container adapted to hold four separate, replaceable, collapsible, tubular, cellular, inner units each of which is formed from a unitary blank of foldable paperboard and includes a pair of triangular cells.

2 Claims, 2 Drawing Sheets

BULK BIN WITH REPLACEABLE CELLS

BACKGROUND OF THE INVENTION

1. Field of the Invention

This invention relates to bulk bins, and more particularly to a bulk bin including a collapsible outer container adapted to hold a plurality of separate, replaceable, collapsible, inner cellular units.

2. Description of the Background Art:

A background art search directed to the subject matter of this application in the United States Patent and Trademark Office disclosed the following U.S. Pat. Nos. 2,673,022, 2,917,222, 3,004,096, 3,356,281 3,397,771, 3,715,072, 3,880,343, 4,102,525, 4,165,030, 4,293,091, 4,351,471.

None of the patents uncovered in the search discloses a composite bulk bin formed of paperboard which includes a collapsible outer container adapted to hold four separate collapsible inner cellular units each of which includes a pair of triangular cells.

SUMMARY OF THE INVENTION

It is an object of the present invention to provide a bulk bin which includes a collapsible, paperboard, outer container adapted to hold a plurality of collapsible, paperboard, inner cellular units.

A more specific object of the invention is the provision, in a bulk bin arrangement of the type described, of inner cellular units formed of paperboard which are collapsible and wherein each includes four side walls secured to each other to form a tube and a pair of center walls secured to each other and extending between diagonally opposite corners of the tube to form a pair of triangular cells.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 7:
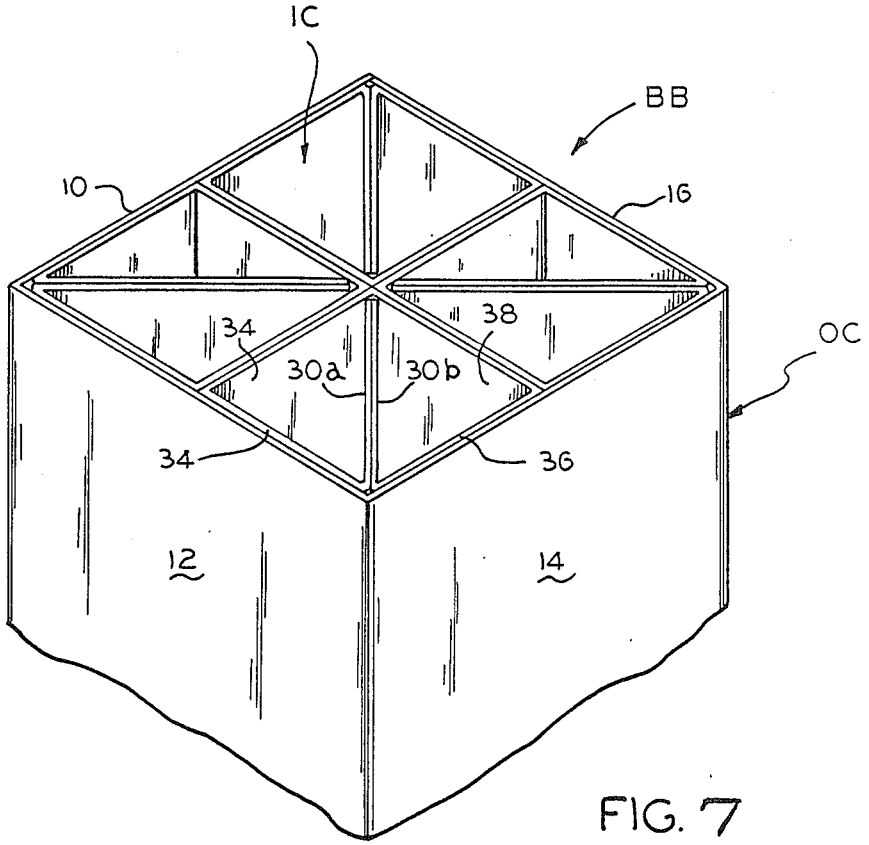
FIG. 7 is a fragmentary perspective view of the composite bin showing the position of the replaceable cellular units within the outer container.

Referring now to the drawings for a better understanding of the invention, and particularly to FIG. 7, it will be seen that the novel composite bulk bin, indicated generally at BB in FIG. 7, includes a rectangular outer container OC adapted to hold a plurality of inner cellular units each of which is indicated generally at IC.

The inner cellular units IC are separate from each other and are replaceable, so that if one of the units is damaged it can be replaced by a similar unit without the expense of discarding the entire composite bulk bin.

The structure of each inner cellular unit, as described later in the specification, is such that the units provide additional strength, both horizontally and vertically, for the composite bulk bin. Thus, the walls of the bin components can be formed from lighter weight paperboard with the bin retaining maximum stacking strength.

Figure 1:
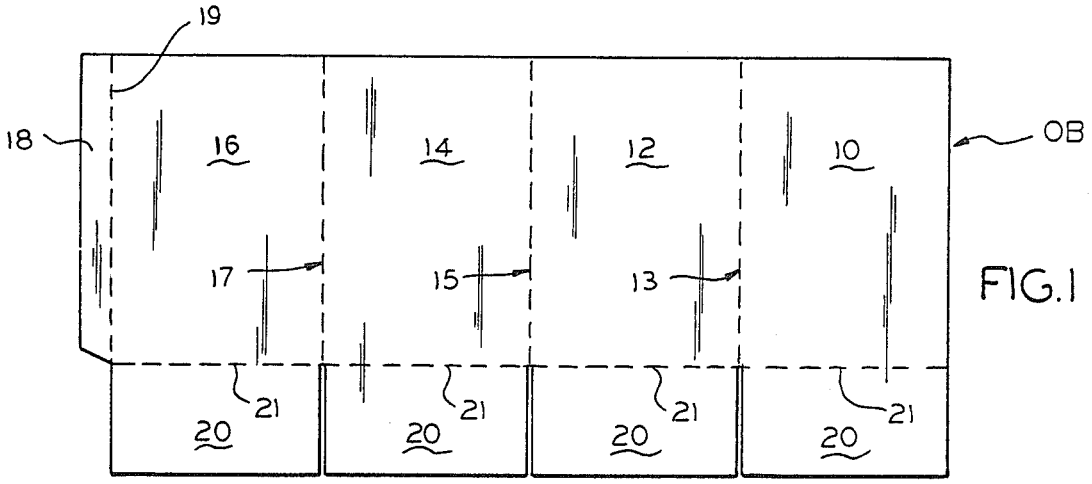
FIG. 1 is a plan view of a blank of foldable sheet material from which the outer container illustrated in the other views may be formed.
Figure 3:
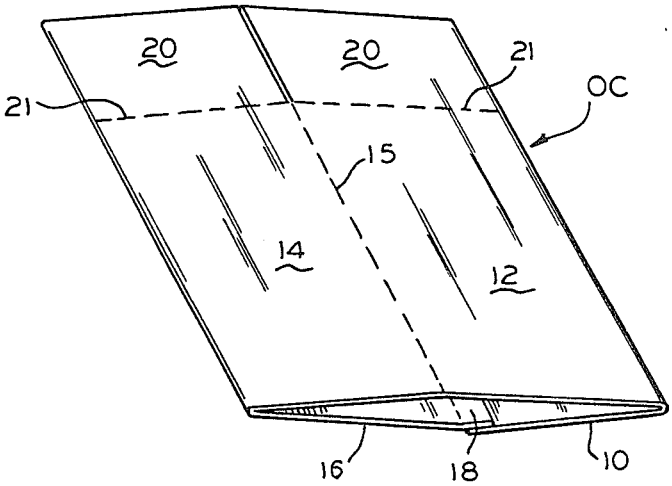
FIG. 3 is a an isometric view of the outer container, shown in a collapsed condition.
Figure 5:
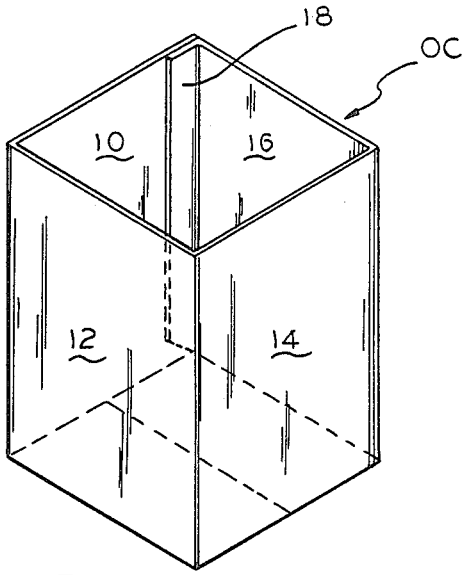
FIG. 5 is an isometric view of the outer container, shown in the erected condition.

As best seen in FIGS. 1, 3, and 5, the outer container OC is formed from a unitary blank OB of foldable sheet material, such as paperboard, and includes a plurality of side wall panels 10, 12, 14, 16, and a glue panel 18, which are foldably joined to each other along fold lines 13, 15, 17, and 19, respectively. Glue panel 18 is secured to first side wall panel 10 to form a collapsible tubular structure, as illustrated in FIG. 3. The bottom of the outer container OC may be closed by a plurality of bottom closure flaps 20 foldably joined along fold lines 21 to the lower ends of the respective side wall panels.

The upper end of the outer container may be closed by a cap (not shown) or by any other means appropriate for the particular use of the bulk bin.

Figure 2:
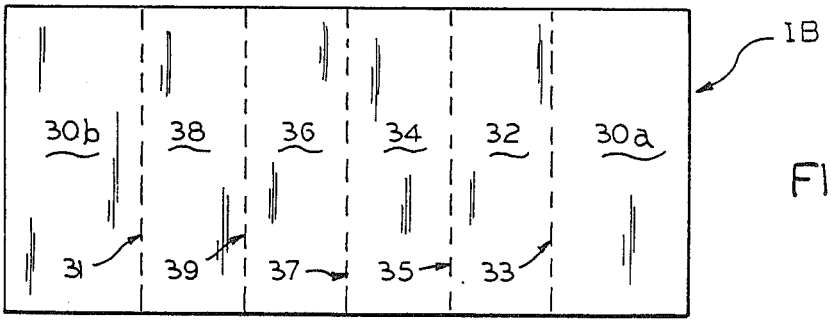
FIG. 2 is a plan view of a blank of foldable sheet material from which one of the inner cellular units illustrated in the other views may be formed.
Figure 4:
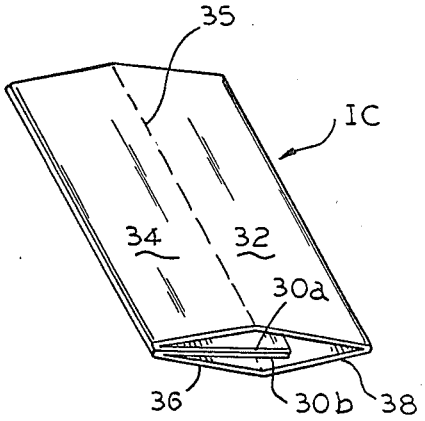
FIG. 4 is an isometric view of an inner cellular unit, shown in a collapsed condition.
Figure 6:
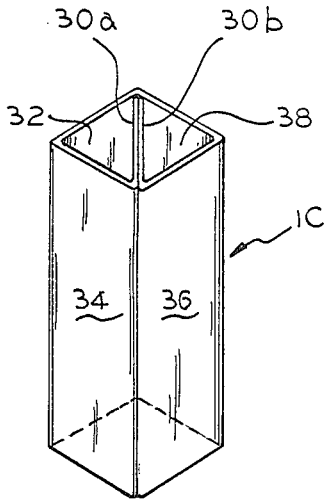
FIG. 6 is an isometric view of an inner cellular unit, shown in the erected condition.

Turning now to FIGS. 2, 4, and 6, it will be seen that each of the inner cellular units IC is formed from a blank IB of foldable sheet material illustrated in FIG. 2 and includes a first inner center panel **30*a*, a first side panel 32, a second side panel 34, a third side panel 36, a fourth side panel 38, and a second inner center panel 30*b*, which are foldably connected to each other along parallel fold lines 33, 35, 37, 39, and 31**, respectively.

As best seen in FIG. 6, when an inner cell IC is erected the inner center panels **30*a* and 30*b*** are adhesively secured to each other in face-to-face relation and are disposed to extend diagonally between opposite corners of the inner cell to provide additional strength.

Further, it will be noted that when the inner cells IC are placed within the outer container OC they are positioned in such a way that the inner cell wall formed by the inner cell panels **30*a* and 30*b*** of each inner cellular unit is in alignment with the corresponding inner cell wall of a diagonally opposite inner cell unit, so there are diagonal walls extending between diagonally opposite corners of the outer container. This provides additional strength, not only lateral strength, but vertical stacking strength.

Also, both the outer container OC and the inner cellular units IC are collapsible so as to occupy less space when not in the erected condition.

What is claimed is:

1. A composite receptacle including an outer container formed from a unitary blank of foldable sheet material, such as paperboard, and including four side wall panels foldably joined to each other to form a collapsible, tubular, outer container adapted to hold four separate, replaceable, collapsible, tubular, cellular, inner units each of which is formed from a unitary blank of foldable sheet material, such as paperboard, and comprises:

(a) four side panels foldably joined to each other to form a rectangular tube;

(b) a pair of inner panels foldably joined to respective side edges of adjacent side panels at one corner of said tube;

(c) said inner panels being disposesd to extend from said one corner to a diagonally opposite corner of said tube and being secured to each other in face-to-face relation to form a diagonal center wall defining a pair of adjacent triangular cells.

2. A receptacle according to claim 1, wherein the center wall of each cellular unit is aligned with a corresponding center wall of a diagonally opposite cellular unit.

* * * * *